US007332993B1

(12) United States Patent
Nussbaum

(10) Patent No.: US 7,332,993 B1
(45) Date of Patent: Feb. 19, 2008

(54) PLANAR TRANSFORMER HAVING FRACTIONAL WINDINGS

(75) Inventor: Michael B. Nussbaum, Newton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 11/733,588

(22) Filed: Apr. 10, 2007

(51) Int. Cl.
*H01F 5/00* (2006.01)

(52) U.S. Cl. ..... 336/200

(58) Field of Classification Search ..... 336/65, 336/83, 200, 206–208, 220–223, 232; 29/602.1, 29/604–606
See application file for complete search history.

(56) References Cited

U.S. PATENT DOCUMENTS

| | | | | |
|---|---|---|---|---|
| 3,855,561 | A | 12/1974 | Gottschalt | |
| 4,249,229 | A * | 2/1981 | Hester | 361/752 |
| 4,494,100 | A | 1/1985 | Stengel et al. | |
| 5,179,365 | A | 1/1993 | Raggi | |
| 5,353,001 | A | 10/1994 | Meinel et al. | |
| 5,565,837 | A | 10/1996 | Godek et al. | |
| 5,801,602 | A | 9/1998 | Fawal et al. | |
| 5,952,909 | A * | 9/1999 | Umeno et al. | 336/192 |
| 6,073,339 | A * | 6/2000 | Levin | 29/606 |
| 6,147,583 | A | 11/2000 | Rinne et al. | |
| 6,307,458 | B1 | 10/2001 | Zhang et al. | |
| 6,326,875 | B1 | 12/2001 | Tuovinen | |
| 6,513,230 | B2 | 2/2003 | Inoue et al. | |
| 6,628,531 | B2 * | 9/2003 | Dadafshar | 361/836 |
| 6,690,256 | B2 | 2/2004 | Ohashi et al. | |
| 6,844,804 | B2 | 1/2005 | Gijs | |
| 6,847,284 | B2 * | 1/2005 | Gamou et al. | 336/223 |
| 7,042,323 | B2 | 5/2006 | Joerg et al. | |
| 2002/0002771 | A1 | 1/2002 | Lin et al. | |
| 2003/0186674 | A1 | 10/2003 | Keeney et al. | |
| 2007/0030107 | A1 | 2/2007 | Waffenschmidt et al. | |

FOREIGN PATENT DOCUMENTS

| | | |
|---|---|---|
| EP | 1 211 701 | 6/2002 |
| GB | 2 355 343 | 4/2001 |

OTHER PUBLICATIONS

Sippola, Developments for the High Frequency Power Transformer Design and Implementation, Helsinki University of Technology Applied Electronics Laboratory, Series E: Electronic Publications E3, Espoo FINLAND 2003, pp. 2-30.

(Continued)

*Primary Examiner*—Tuyen T. Nguyen
(74) *Attorney, Agent, or Firm*—Fish & Richardson P.C.

(57) ABSTRACT

A planar transformer is fabricated on a multilayer printed circuit board having more than two layers. A magnetic core includes a common leg and a first and a second return leg that form a first and second core window, respectively. A first coil includes a first coil winding formed on the circuit board. The first coil winding passes through each of the first and second core windows. A second coil includes a plurality of coil windings formed on the circuit board. Two or more of the plurality of coil windings include fractional turn windings. Each of the plurality of coil windings passes through at least one of the first and the second core windows and is interconnected such that the sum of ampere turn products from all of the coil windings passing through each of the first and the second core windows is substantially equal to zero.

40 Claims, 5 Drawing Sheets

OTHER PUBLICATIONS

Papastergiou, The Simulation of Fractional Turns in SMPS Transformers, University of Edinburgh, Downloaded Jun. 29, 2006.
Magnetics, Designing with Planar Ferrite Cores, Technical Bulletin, Bulletin FC-S8, pp. 3-12, 2001.
Holmes, et al. Flat Transformers for Low Voltage, High Current, High Frequency Power Converters, 3122 Alpine Avenue, Santa Ana, California, USA, Paper presented at HFPOC Power Conversion, PowerSystems World Sep. 1996.
Dixon, Jr., How to Design a Transfomer with Fractional Turns, pp. R6-1 thru R6-8, Dallas, Texas, Copyright 2003.
Dadafshar, Exploiting Integrated Planar Magnetics, Power Electronics Technology, Jan. 2005, pp. 40-48.
Zhou, et al., Applications of Half-Turn on E-Core in Switching Power Supplies, Potant Technologies, Inc. Research Lab, 1700 Kraft Drive, Suite 1200, Blacksburg, VA 24060, pp. 1210-1215, 0-7803-5160-6/99, 1999 IEEE.
Bloom, Planar Power Magnetics, Reprinted from the Aug. 2002 issue of Magnetics Business & Technology, Webcom Communications Corp. 7355 E. Orchard Road, Suite 100 Greenwood Village, CO, USA.
Magnetics, Desiging with Planar Ferrite Cores, Technical Bulletin, Bulletin FC-S8, pp. 3-12., copyright 2001.

* cited by examiner

PLANAR TRANSFORMER HAVING FRACTIONAL WINDINGS

BACKGROUND OF THE INVENTION

Fractional turns used in switching power supply transformers can significantly increase the voltage resolution between a primary and a secondary winding. For example, it may be desirable in certain applications to have particular ratios of input voltage to one or more output voltages. This ratio is usually determined by the relative number of turns, or "turns ratio" of the various windings of the transformer.

SUMMARY OF THE INVENTION

In one embodiment, a planar transformer is fabricated on a multilayer printed circuit board having more than two layers. The planar transformer includes a magnetic core that is coupled to the multilayer printed circuit board. The magnetic core includes a common leg and at least a first and a second return leg. The common leg and the first return leg form a first core window. The common leg and the second return leg form a second core window. A first coil includes a first coil winding formed on one or more layers of the multilayer printed circuit board. The first coil winding passes through each of the first and second core windows. A second coil includes a plurality of coil windings formed on one or more layers of the multilayer printed circuit board. Two or more of the plurality of coil windings are fractional turn windings. Each of the plurality of coil windings pass through at least one of the first and the second core windows and are interconnected such that the sum of ampere turn products from all of the coil windings passing through each of the first and the second core windows is substantially equal to zero.

The magnetic core can also include a third return leg that forms a third core window. In one embodiment, at least two of the fractional windings are half turn windings. In one embodiment, the common leg and a plurality of return legs correspond to a plurality of core windows. In one embodiment, a magnetic flux generated in the common leg is substantially equally distributed in the plurality of return legs.

In one embodiment, the absolute value of the difference between an ampere turn product from the first coil winding passing through the first core window and the sum of ampere turn products of the plurality of coil windings passing through the first core window is less than ten percent of the ampere turn product from the first coil winding passing through the first core window.

In one embodiment, the absolute value of the difference between an ampere turn product from the first coil winding passing through the second core window and the sum of ampere turn products of the plurality of coil windings passing through the second core window is less than ten percent of the ampere turn product from the first coil winding passing through the second core window.

In some embodiments, one or more of the common leg, the first return leg, and the second return leg passes through the multilayer printed circuit board. The magnetic core can include multiple parts. The multiple parts can be coupled together from opposite sides of the printed circuit board.

In one embodiment, the first coil is the primary coil and the second coil is the secondary coil. In another embodiment, the second coil is the primary winding and the first coil is the secondary coil. In one embodiment, the magnetic core includes a pre-fabricated magnetic material. In one embodiment, the planar transformer is a component in an audio amplifier.

In another embodiment, a power supply includes a voltage input terminal. The power supply also includes a planar transformer electrically coupled to the voltage input terminal. The planar transformer is fabricated on a multilayer printed circuit board having more than two layers. The planar transformer includes a magnetic core that is coupled to the multilayer printed circuit board. The magnetic core includes a common leg and at least a first and a second return leg. The common leg and the first return leg form a first core window. The common leg and the second return leg form a second core window. A first coil includes a first coil winding formed on one or more layers of the multilayer printed circuit board. The first coil winding passes through each of the first and second core windows. A second coil includes a plurality of coil windings formed on one or more layers of the multilayer printed circuit board. Two or more of the plurality of coil windings are fractional turn windings. Each of the plurality of coil windings pass through at least one of the first and the second core windows and are interconnected such that the sum of ampere turn products from all of the coil windings passing through each of the first and the second core windows is substantially equal to zero. An output terminal is coupled to the planar transformer.

In one embodiment, the output terminal supplies voltage to an audio amplifier. The magnetic core can include the common leg and a plurality of return legs that correspond to a plurality of core windows. In one embodiment, a magnetic flux generated in the common leg is substantially equally distributed in the plurality of return legs.

In one embodiment, the absolute value of the difference between an ampere turn product from the first coil winding passing through the first core window and the sum of ampere turn products of the plurality of coil windings passing through the first core window is less than ten percent of the ampere turn product from the first coil winding passing through the first core window.

In one embodiment, the absolute value of the difference between an ampere turn product from the first coil winding passing through the second core window and the sum of ampere turn products of the plurality of coil windings passing through the second core window is less than ten percent of the ampere turn product from the first coil winding passing through the second core window.

In one embodiment, two or more of the fractional windings comprise half turn windings. The magnetic core can be fabricated from a pre-fabricated magnetic material. In one embodiment, one or more of the common leg, the first return leg, and the second return leg passes through the multilayer printed circuit board. The magnetic core can include multiple parts. The multiple parts are coupled together from opposite sides of the printed circuit board.

A method for transforming an electrical current, according to one embodiment, includes forming a magnetic core comprising a first core window and a second core window. The magnetic core is coupled to a multilayer printed circuit board including more than two layers. A first coil having a first coil winding is formed on one or more layers of a multilayer printed circuit board. The first coil winding passes through each of the first and second core windows. A second coil having a plurality of coil windings is formed on one or more layers of the multilayer printed circuit board. Two or more of the plurality of coil windings include fractional turn windings. Each of the plurality of coil windings pass through at least one of the first and the second core windows and are interconnected such that the sum of ampere turn products from all of the coil windings passing through each of the first and the second core windows is substantially equal to zero.

In one embodiment, two or more of the fractional windings are half turn windings. In one embodiment, the magnetic core includes a common leg and a plurality of return legs that correspond to a plurality of core windows. The method can further include generating a magnetic flux in the common leg and equally distributing the magnetic flux in the plurality of return legs. The method can also include passing at least one of the common leg, the first return leg, and the second return leg through the multilayer printed circuit board.

In one embodiment, a planar transformer includes a multilayer printed circuit board having more than two layers. A first coil includes at least one full turn winding formed on one or more layers of the multilayer printed circuit board. A second coil includes a plurality of windings formed on one or more layers of the multilayer printed circuit board. Two or more of the plurality of windings are fractional turn windings that are connected in a parallel configuration. A magnetic core inductively couples the plurality of windings to the at least one full turn winding. The magnetic core includes two or more core windows corresponding to the at least two fractional turn windings.

In one embodiment, each of the at least two fractional windings passes through one of the at least two core windows. The magnetic core can include a common leg and a plurality of legs that correspond to a plurality of core windows. In one embodiment, two or more of the fractional windings are half turn windings.

In one embodiment, the absolute value of the difference between an ampere turn product from the full turn winding passing through one of the two core windows and the sum of ampere turn products of the plurality of coil windings passing through the one of the two core windows is less than ten percent of the ampere turn product from the full turn winding passing through the one of the two core windows. The magnetic core can be fabricated from a pre-fabricated magnetic material. In one embodiment, the transformer is a component of an audio amplifier.

A method for transforming an electrical current, according to one embodiment, includes forming a first coil having at least one full turn winding on one or more layers of a multilayer printed circuit board having more than two layers. A second coil having a plurality of windings is formed on one or more layers of the multilayer printed circuit board. Two or more of the plurality of windings are fractional turn windings that are connected in a parallel configuration. A magnetic core having two or more core windows that correspond to the two or more fractional turn windings inductively couples the plurality of windings to the at least one full turn winding.

In one embodiment, two or more of the fractional windings are half turn windings. In one embodiment, the absolute value of the difference between an ampere turn product from the full turn winding passing through one of the two core windows and the sum of ampere turn products of the plurality of coil windings passing through the one of the two core windows is less than ten percent of the ampere turn product from the full turn winding passing through the one of the two core windows.

BRIEF DESCRIPTION OF THE DRAWINGS

This invention is described with particularity in the detailed description. The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

Figure 1A:
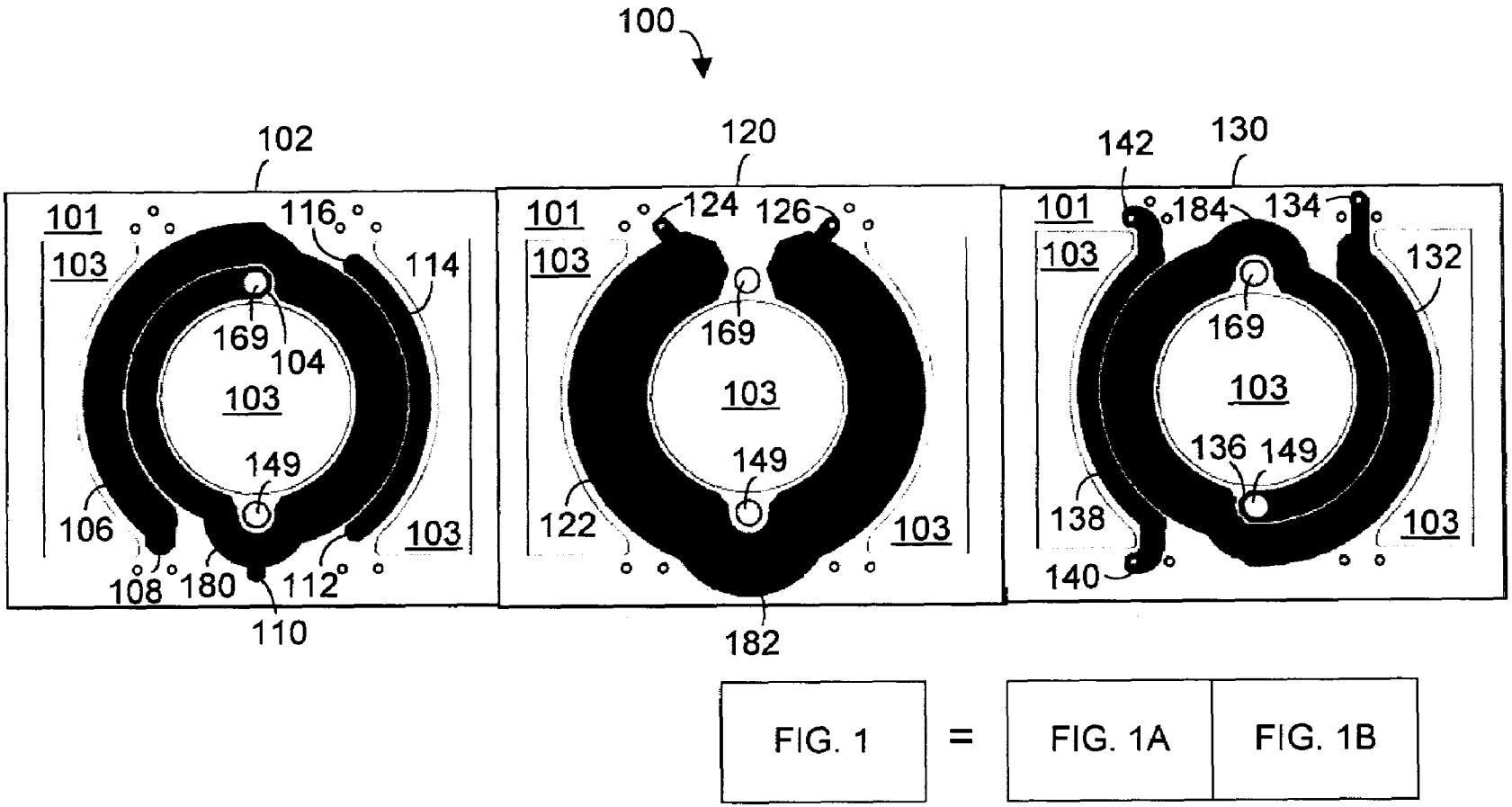
FIGS. 1A, 1B illustrate one embodiment of a transformer fabricated on a multiple layer printed circuit board.

Fractional turns used in switching power supply transformers can significantly increase the voltage resolution between a primary and a secondary winding. As switching frequencies increase and the required primary turns count decreases, it is more and more difficult to get the desired turns ratio between windings using integer turns counts. For example, megahertz (MHz) switching power converters operating from an automotive 14.4 Volt bus only require a single turn primary and fractional turns can be used to step down, or to get any significant resolution in available step-up ratios.

A planar transformer for an audio amplifier according to one embodiment is fabricated on a multilayer printed circuit board. The multilayer printed circuit can include more than two layers. A first coil including one or more coil windings is formed on one or more layers of the multilayer printed circuit board. A second coil including a plurality of coil windings is formed on one or more layers of the multilayer printed circuit board. A number of the plurality of second coil windings include fractional windings. The first coil can be the primary coil or the secondary coil. The second coil can be the primary coil or the secondary coil.

A magnetic core inductively couples the first coil to the second coil. The core can include a common leg, a first return leg and a second return leg. The common leg and the first return leg create a first core window. The common leg and the second return leg create a second core window. The common leg and any plurality of return legs correspond to a plurality of core windows. Each fractional winding passes through a core window. By a "fractional winding" we mean a partial turn winding that passes through less than all of the core windows. The fractional value of the partial turn winding cannot be smaller than the reciprocal of the number of core windows. For example, in a transformer having two core windows, the fractional value of the partial turn winding cannot be smaller than one-half. In a transformer having three core windows, the fractional value of the partial turn winding cannot be smaller than one-third. In a transformer having four core windows, the fractional value of the partial turn winding cannot be smaller than one-quarter. However, the fractional value of a partial turn winding in a transformer having four windows can be one-half or three-quarters, for example.

As will be described in more detail herein, the sum of ampere-turn products from all of the coil windings passing through each core window is substantially equal to zero. In general, this condition requires that the number of fractional turn windings be constrained by symmetry in the ampere-turn products through each core window. One way to satisfy the symmetrical ampere-turn products is to have one fractional turn winding in each core window and to connect these fractional turn windings in parallel so they have an equal current. For example, a transformer having two core windows requires an integer multiple of two half-turn windings. A transformer having three core windows requires an integer multiple of three one-third turn windings, for example.

Figure 1B:
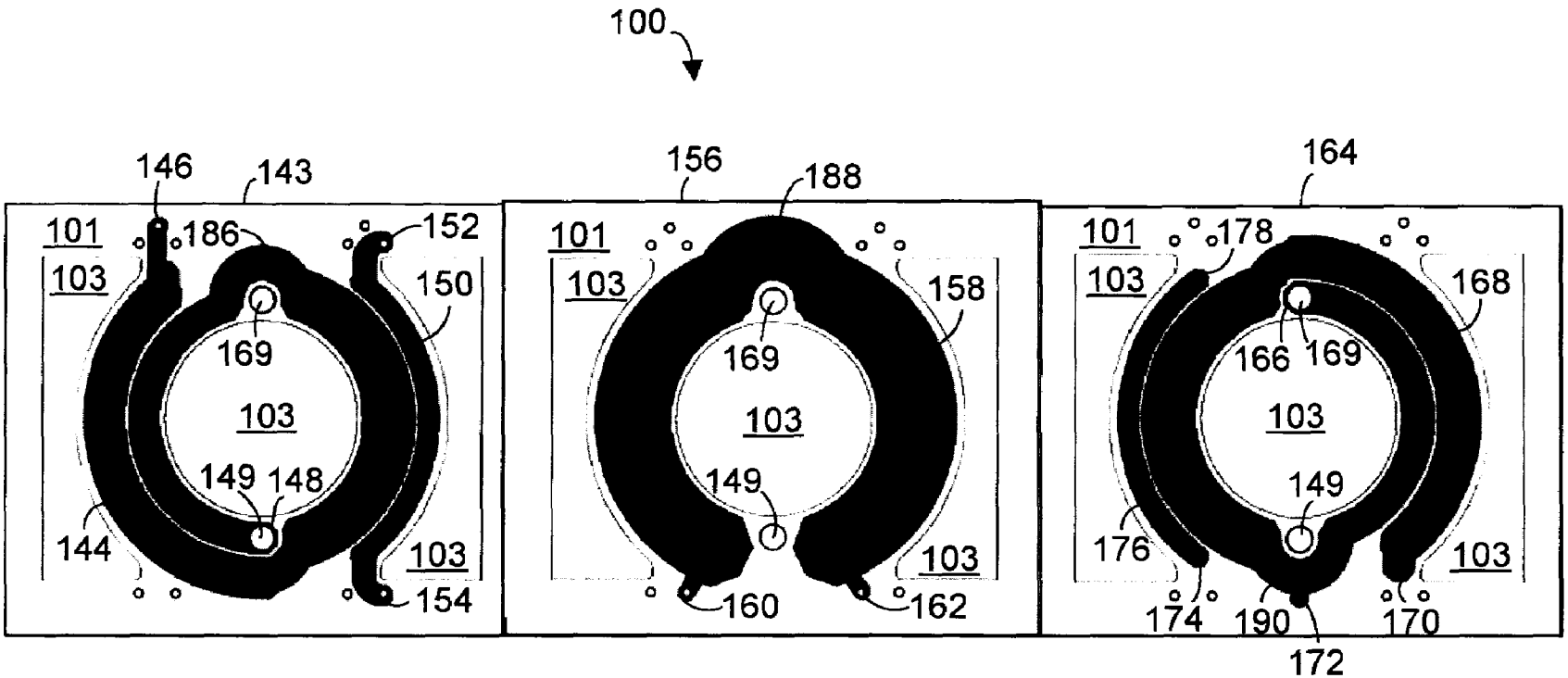

FIG. 1 illustrates a transformer 100 fabricated on a multiple layer printed circuit board 101 according to one embodiment of the invention. In one embodiment, the transformer 100 is an autotransformer. The term "autotransformer" as used herein denotes a transformer that includes a single, continuous winding that is tapped to provide either a step-up or step-down function. In this configuration, the transformer 100 has at least part of the windings common to both primary and secondary circuits. The voltage across the secondary winding has the same relationship to the voltage across the primary that it would have if they were two distinct windings. The techniques and principles taught by embodiments of the present invention are not limited to autotransformer configurations and can also be applied to transformers with electrically isolated winding configurations.

The multiple layer printed circuit board 101 includes six layers. The layers are positioned on top of each other in a layered configuration, but are shown adjacent to each other for illustrative purposes. The multiple layer printed circuit board 101 can include apertures 103 for receiving a ferrite core (not shown). The ferrite core (not shown) can include a top section and a bottom section. The top section and the bottom section are assembled together such that a portion of the top and/or bottom section is positioned inside the aperture 103. The ferrite core can include an E-shaped core or can be a core having any suitable shape. In one embodiment, the ferrite core (not shown) can include two symmetric E-shaped cores that are coupled together from opposite sides of the multiple layer printed circuit board 101. The ferrite core can be pre-fabricated material. For example, the ferrite core can be formed through pressing and sintering.

There are several techniques that can be used to assemble the ferrite core. For example, a mechanical clip (not shown) can be used to hold the top section and the bottom section together. The top section and the bottom section can sometimes include slots to receive the mechanical clip. The slots prevent the mechanical clip from adding additional height to the assembly and prevent the top section and the bottom section from moving laterally. Alternatively, tape can be used to assemble the ferrite core. In one embodiment, a high temperature adhesive is used to assemble the ferrite core.

In one embodiment, the transformer 100 includes a first layer 102 having a first terminal 104 that is electrically coupled to a first coil winding 106. The first coil winding 106 is a one and one-half turn winding that is terminated at a second terminal 108. In this embodiment, the first coil winding 106 is tapped at terminal 110. The term "tap" as used herein denotes a connection point along a transformer winding that allows the number of turns to be selected. In this case, terminal 110 selects a half turn of first coil winding 106.

A first fractional turn winding 114 is a half turn winding having a third terminal 112 and a fourth terminal 116. The term "fractional turn winding" as used herein denotes a winding that is less than a full turn. For example, although in this embodiment, the first fractional turn winding 114 is a half-turn winding, the fractional turn winding can be a third-turn winding. Using known techniques not described in detail herein, the first coil winding 106 as well as the first fractional turn winding 114 can be formed either by chemically etching a layer of electrically conducting material, such as copper, deposited on the face of a circuit board, or by depositing electrically conducting material on the face of the circuit board. The first coil winding 106 as well as the first fractional turn winding 114 can be circular, helical, rectangular, or any other suitable shape.

A second layer 120 includes a second coil winding 122. The second coil winding 122 is a full turn winding having a fifth 124 and sixth terminal 126. A third layer 130 includes a third coil winding 132. The third coil winding 132 includes one and one-half turn windings having a seventh 134 and eighth terminal 136. The third layer 130 also includes a second fractional turn winding 138 having ninth 140 and tenth terminals 142.

A fourth layer 143 includes a fourth coil winding 144. The fourth coil winding 144 includes one and one-half turn windings having a eleventh 146 and twelfth terminal 148. The twelfth terminal 148 is coupled to the eighth terminal 136 of the third layer 130 through a via 149. The term "via" as used herein denotes a metalized through hole that couples one layer of a printed circuit to another layer. A via can also be used to make an electrical connection from one winding to other circuit components (not shown). The fourth layer 143 also includes a third fractional winding 150 having thirteenth 152 and fourteenth terminals 154. A fifth layer 156 includes a fifth coil winding 158. The fifth coil winding 158 is a full turn winding having a fifteenth 160 and sixteenth terminal 162.

A sixth layer 164 can include a seventeenth terminal 166 that is electrically coupled to a sixth coil winding 168. The seventeenth terminal 166 is electrically coupled to the first terminal 104 of the first layer 102 through via 169. The sixth coil winding 168 is a one and one-half turn winding that is terminated at a eighteenth terminal 170. Terminal 172 is used to tap the sixth coil winding 168, selecting a half turn of sixth coil winding 168. A fourth fractional winding 176 includes a nineteenth terminal 174 and a twentieth terminal 178.

Although the coil windings are substantially spiral in shape, various discontinuities are designed into the windings. These discontinuities can be used to optimize the layout of the transformer 100. For example, jumpers 180, 182, 184, 186, 188, and 190 can be used to complete a current path through the various coils. The jumpers can slightly modify the shape of each spiral coil, but these small irregularities in the shapes of the coils do not substantially impact the performance of the transformer 100.

Figure 2:
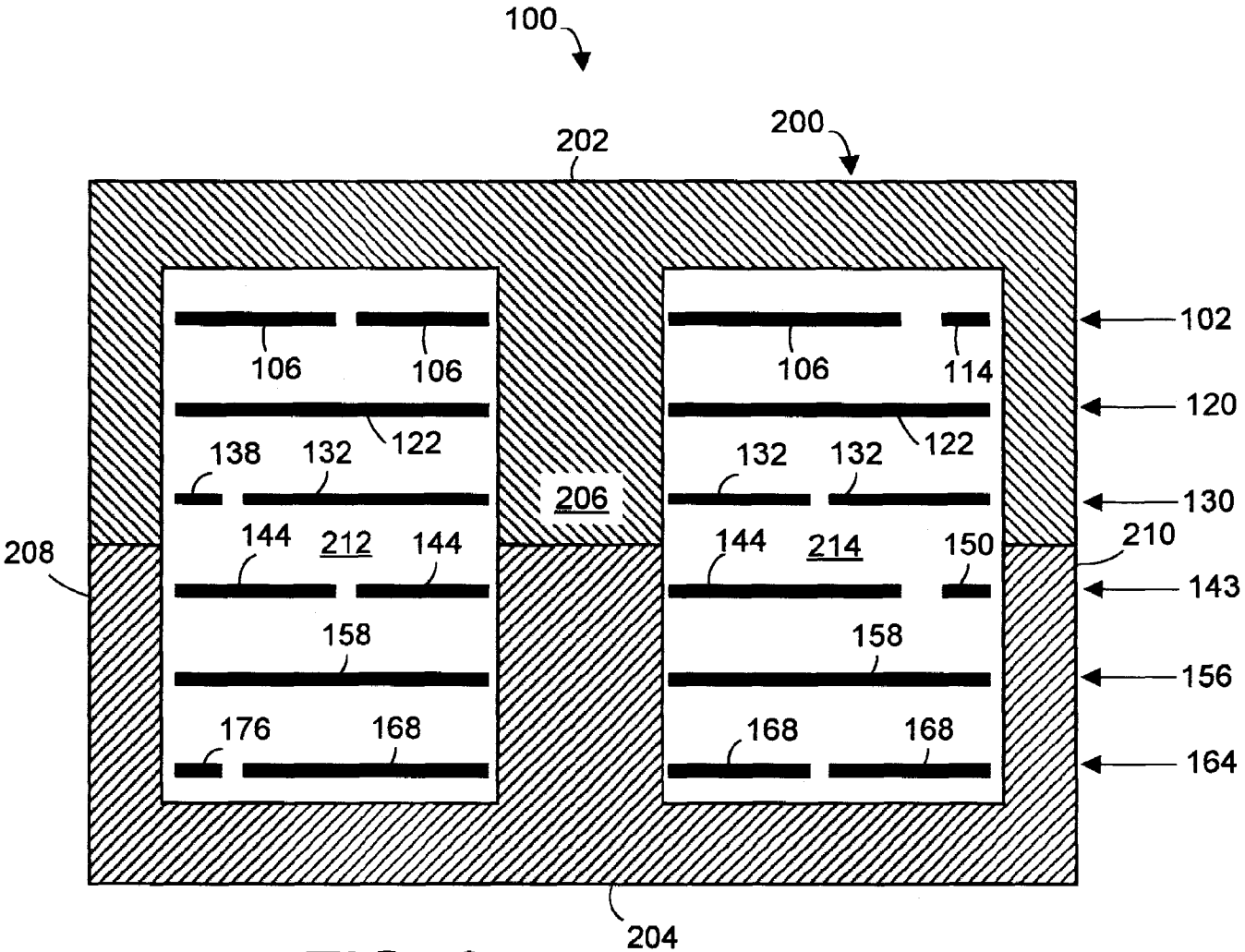
FIG. 2 illustrates a cross-sectional view of the transformer of FIG. 1.

FIG. 2 illustrates a cross-sectional view of the transformer 100 of FIG. 1. The first layer 102 and the sixth layer 164 are mirror images of one another. The second layer 120 and the fifth layer 156 are also mirror images of one another. The third layer 130 and the fourth layer 143 are also mirror images of one another. A core 200 having a top section 202 and a bottom section 204 is assembled through the aperture 103 (FIG. 1) of the multi-layer circuit board 101. The top section 202 and the bottom section 204 can embody an E-shaped core. The core 200 can be any other suitably shaped core. For example, one or more cup-shaped cores can be used.

The core 200 includes a common leg 206, a first return leg 208 and a second return leg 210. The common leg 206 and the first return leg 208 create a first core window 212. The common leg 206 and the second return leg 210 create a second core window 214. The common leg 206 and any plurality of return legs correspond to a plurality of core windows.

The first layer 102 includes the first coil winding 106 and the first fractional turn winding 114. The first coil winding 106 is a one and one-half turn winding that twice passes through the first core window 212 and once passes through the second core window 214. The first fractional turn winding 114 passes though the second core window 214 once.

The second layer 120 includes the second coil winding 122. The second coil winding 122 is a full turn winding that passes through the first core window 212 and the second core window 214.

The third layer 130 includes the third coil winding 132 and the second fractional turn winding 138. The third coil winding 132 is a one and one-half turn winding that once passes through the first core window 212 and twice passes through the second core window 214. The second fractional turn winding 138 passes though the first core window 212 once.

The fourth layer 143 includes the fourth coil winding 144 and the third fractional turn winding 150. The fourth coil winding 144 is a one and one-half turn winding that twice passes through the first core window 212 and once passes through the second core window 214. The third fractional turn winding 150 passes though the second core window 214 once.

The fifth layer 156 includes the fifth coil winding 158. The fifth coil winding 158 is a full turn winding that passes through the first core window 212 and the second core window 214.

The sixth layer 164 includes the sixth coil winding 168 and the fourth fractional turn winding 176. The sixth coil winding 168 is a one and one-half turn winding that once passes through the first core window 212 and twice passes through the second core window 214. The fourth fractional turn winding 176 passes though the first core window 212 once.

The various coil windings on the various layers can be fabricated with different widths and different thicknesses. For example, the second coil winding 122 is significantly wider than both the first coil winding 106 and the first fractional turn winding 114. The shape, width, and thickness of each coil winding are designed to optimize the performance of the transformer 100. Various other shapes and sizes of the coil windings can also be used. For example, thicker coils can generally conduct higher currents than thinner coils. Additionally, wider coils can generally conduct higher currents than narrow coils.

The transformer 100 of FIG. 2 includes a first coil having a coil winding. The coil winding can include one or more turns and can support a current. The current in the coil winding multiplied by the number of turns of the coil winding is referred to as an ampere turn product. Each coil in a plurality of coils can include an ampere turn product and the total of the ampere turn products of the plurality of coils is referred to as the sum of ampere turn products.

Each core window 212, 214 can include two or more coil windings. In one embodiment, the sum of the ampere turn products from all of the coil windings in each core window 212, 214 is substantially equal to zero. By substantially equal to zero, we mean (in a transformer having a primary coil winding and a secondary coil winding that both pass through a core window) that the absolute value of the difference between the ampere turn product from the primary coil winding passing through the core window and the ampere turn product from the secondary coil winding passing through the core window is less than ten percent of the ampere turn product from the primary coil winding passing through the core window.

The current in a transformer can be divided into a magnetizing current and a load current. In the disclosure herein, the load currents and their reflection in the primary winding sum to substantially zero assuming that the magnetizing current is ignored. There will always be a magnetizing current component to the primary current. This magnetizing current is substantially independent of the load current, and is typically less than ten percent of the maximum primary reflected load current. The values of the magnetizing current for different loads can be established by using standard transformer design techniques which will not be described herein. The magnetizing current will essentially be ignored in the following description.

The embodiment of FIG. 2 can include an additional constraint on the sum of ampere turn products in each core window 212, 214. Each primary coil passes once through each core window 212, 214 such that the sum of ampere turn products from the primary coils in each core window 212, 214 is substantially equal. Thus, the magnetic flux through each core window 212, 214 is also substantially equal and results in a balanced configuration.

In a magnetic core having multiple windows, the sum of ampere turn products from the total number of coil windings passing through each core window can be equal in a balanced configuration. For example, in a magnetic core having two core windows, the sum of ampere turn products from the total number of coil windings passing through the first core window and the sum of ampere turn products from the total number of coil windings passing through the second core window are equal and result in a balanced magnetic flux in the magnetic core.

The core can be divided into any number of sections or core windows, each core window can have an equal magnetic cross section. In one embodiment, each core window produces a balanced magnetic load.

In one embodiment, a fractional turn winding passes through each core window. Since each core window includes a fractional turn, these fractional turns can have essentially equal load currents. One way to achieve equal load currents is to configure the fractional turns in parallel. In one embodiment, currents induced in the fractional windings generate a balanced magnetic flux through the magnetic core.

Figure 3:
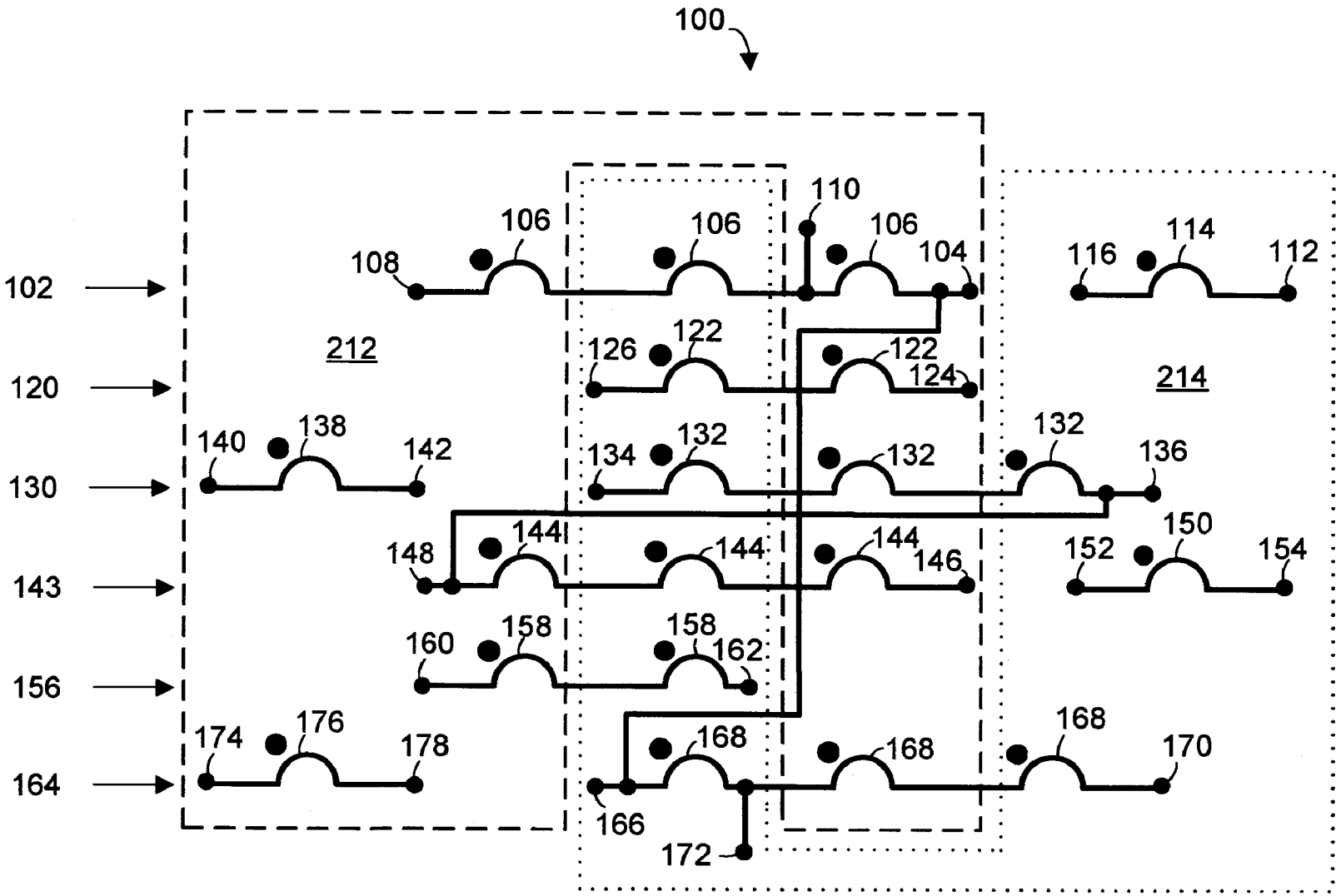
FIG. 3 is a schematic illustration of the transformer of FIG. 1.

FIG. 3 is a schematic illustration of the transformer 100 of FIG. 1. The schematic illustration shows a first core window 212 and a second core window 214. The first layer 102 includes the first coil winding 106. The first coil winding 106 includes one and one-half turns. One half-turn of the first coil winding 106 passes through the first core window 212 and another half-turn of the first coil winding 106 passes through the second core window 214. The other half-turn of the first coil winding 106 also passes through the first core window 212.

A tap terminal 110 is provided for first coil winding 106. The black dot at one terminal or the other of each winding is called a phase or polarity mark. Currents entering the marked terminals create magnetic flux in the same direction in the core.

A positive voltage applied across a marked terminal of a winding will result in a positive voltage at the marked terminal of a magnetically coupled winding. If an unmarked terminal of a winding is connected to a marked terminal of a magnetically coupled winding, the two windings will be in phase and their ampere-turns will add. If they are connected in the opposite sense, their ampere-turns will cancel.

The first terminal 104 of the first coil winding 106 is electrically coupled to the seventeenth terminal 166 of the sixth coil winding 168. This electrical coupling is achieved through via 169 (FIG. 1). The first layer 102 also includes the first fractional winding 114. The first fractional winding 114 passes through the second core window 214.

The second layer 120 includes the second coil winding 122. The second coil winding 122 includes one full turn. One-half turn of the second coil winding 122 passes through the first core window 212. The other one-half turn of the second coil winding 122 passes through the second core window 214.

The third layer 130 includes the third coil winding 132 and the second fractional winding 138. The third coil winding 132 includes one and one-half turns. One half-turn of the third coil winding 132 passes through the second core window 214. Another half-turn of the third coil winding 132 passes through the first core window 212 and the other half-turn of the third coil winding 132 passes through the second core window 214. The second fractional winding 138 passes through the first core window 212.

The eighth terminal 136 of the third coil winding 132 is electrically coupled to the twelfth terminal 148 of the fourth coil winding 144. This electrical coupling is achieved through via 149 (FIG. 1).

The fourth layer 143 includes the fourth coil winding 144. The fourth layer 143 also includes the third fractional winding 150. The fourth coil winding 144 includes one and one-half turns. One half-turn of the fourth coil winding 144 passes through the first core window 212 and another half-turn of the fourth coil winding 144 passes through the second core window 214. The other half-turn of the fourth coil winding 144 also passes through the first core window 212. The third fractional winding 150 passes through the second core window 214.

The fifth layer 156 includes the fifth coil winding 158. The fifth coil winding 158 includes one full turn. One-half turn of the fifth coil winding 158 passes through the first core window 212. The other one-half turn of the fifth coil winding 158 passes through the second core window 214.

The sixth layer 164 includes the sixth coil winding 168. The sixth layer 164 also includes the fourth fractional winding 176. The sixth coil winding 168 includes one and one-half turns. One half-turn of the sixth coil winding 168 passes through the second core window 214. Another half-turn of the sixth coil winding 168 passes through the first core window 212 and the other half-turn of the sixth coil winding 168 passes through the second core window 214. The fourth fractional winding 176 passes through the first core window 212.

A terminal tap 172 is provided for sixth coil winding 168. The first terminal 104 of the first coil winding 106 is electrically coupled to the seventeenth terminal 166 of the sixth coil winding 168. This electrical coupling is achieved through via 169.

In one embodiment, the sum of the ampere turn products from all of the coil windings in each core window 212, 214 is substantially equal to zero. The following nomenclature will be used while referring to FIG. 3 and FIG. 4. A current "$I_{YYY}$" represents the current flow at a terminal "YYY". A winding turn "$T_{XXX}$" represents the winding turn "XXX" through a core window. For example, the sum of ampere-turn products of windings passing through the first window 212 with the transistor Q3 (FIG. 4) in the on-state and the transistor Q4 (FIG. 4) in the off-state can be expressed by the following:

$$-I_{108}2T_{106}-I_{110}T_{106}-I_{126}T_{122}-I_{142}T_{138}-I_{134}T_{132}-I_{146}2T_{144}+I_{162}T_{158}-I_{174}T_{176}-I_{170}T_{168}=0$$

and $I_{108}=I_{126}=I_{142}=I_{134}=I_{172}=0$, since there is essentially no current flow through these terminals when $Q_3$ (FIG. 4) is in the on-state and $Q_4$ (FIG. 4) is in the off-state. Rearranging the previous equation yields the following:

$$I_{162}T_{158}=I_{110}T_{106}+2I_{146}T_{144}+I_{174}T_{176}+I_{170}T_{168}.$$

Since $T_{XXX}$ represents one winding pass through the first window 212, we can set $T_{XXX}$ equal to 1, which yields:

$$I_{162}=I_{110}+2I_{146}+I_{174}+I_{170}.$$

The sum of ampere-turn products of windings passing through the second window 214 with the transistor Q3 (FIG. 4) in the on-state and the transistor Q4 (FIG. 4) in the off-state can be expressed by the following:

$$-I_{108}T_{106}-I_{112}T_{114}-I_{126}T_{122}-I_{134}2T_{132}-I_{146}T_{144}-I_{152}T_{150}+I_{162}T_{158}-I_{174}T_{168}-I_{170}2T_{168}=0$$

and $I_{108}=I_{112}=I_{126}=I_{134}=I_{172}=0$. Rearranging the previous equation yields the following:

$$I_{162}T_{158}=I_{146}T_{144}+I_{152}T_{150}+2I_{170}T_{168}.$$

Since $T_{XXX}$ represents one winding pass through the second window 214, we can set $T_{XXX}$ equal to 1, which yields:

$$I_{162}=I_{146}+I_{152}+2I_{170}.$$

The current $I_{162}$ flowing through the first window 212 and the current $I_{162}$ flowing through the second window 214 must be equal. Thus, $$I_{162}(\text{through window } \mathbf{212})=I_{162}(\text{through window } \mathbf{214})$$

and $$I_{110}+2I_{146}+I_{174}+I_{170}=I_{146}+I_{152}+2I_{170}$$

and rearranging the previous equation yields, $$I_{110}+I_{146}+I_{174}=I_{152}+I_{170}.$$

Since the current $I_{174}$ and the current $I_{152}$ both feed the voltage $+(1.5*V_{LL})$, they are essentially equal in value. Additionally, since the current $I_{170}$ and the current $I_{146}$ both feed the voltage $-(1.5*V_{LL})$, they are also essentially equal in value. This leads to the conclusion that $I_{110}$ must be equal to zero, since all ampere-turn products through each window 212, 214 sum to zero, ignoring magnetizing current.

Thus, all ampere-turn products sum to zero except for $I_{110}$. It should be noted that $I_{110}$ feeds the voltage $+(0.5*V_{LL})$. However, the current $I_{110}$ is a small current compared with the current $I_{162}$. In one embodiment, the value of the current $I_{110}$ is less than ten percent of the value of the current $I_{162}$.

The sum of ampere-turn products of windings passing through the first window 212 with the transistor Q3 (FIG. 4) in the off-state and the transistor Q4 (FIG. 4) in the on-state can be expressed by the following:

$$+I_{108}2T_{106}+I_{110}T_{106}-I_{126}T_{122}+I_{142}T_{138}+I_{134}T_{132}+I_{146}2T_{144}+I_{162}T_{158}+I_{174}T_{176}+I_{170}T_{168}=0$$

and $I_{110}=I_{146}=I_{162}=I_{174}=I_{170}=0$, since there is essentially no current flow through these terminals when $Q_3$ (FIG. 4) is in the off-state and $Q_4$ (FIG. 4) is in the on-state. Rearranging the previous equation yields the following:

$$I_{126}T_{122}=I_{108}2T_{106}+I_{142}T_{138}+I_{134}T_{132}.$$

Since $T_{XXX}$ represents one winding pass through the first window 212, we can set $T_{XXX}$ equal to 1, which yields:

$$I_{126}=2I_{108}+I_{142}+I_{134}.$$

The sum of ampere-turn products of windings passing through the second window 214 with the transistor Q3 (FIG. 4) in the off-state and the transistor Q4 (FIG. 4) in the on-state can be expressed by the following:

$$+I_{108}T_{106}+I_{112}T_{114}-I_{126}T_{122}+I_{134}2T_{132}+I_{146}T_{144}+I_{152}T_{150}+I_{162}T_{158}+I_{172}T_{168}+I_{170}2T_{168}=0$$

and $I_{146}=I_{152}=I_{162}=I_{170}=0$. Rearranging the previous equation yields the following:

$$I_{126}T_{122}=I_{108}T_{106}+I_{112}T_{114}+I_{134}2T_{132}+I_{172}T_{168}.$$

Since $T_{xxx}$ represents one winding pass through the second window 214, we can set $T_{xxx}$ equal to 1, which yields:

$$I_{126}=I_{108}+I_{112}+2I_{134}+I_{172}.$$

The current $I_{126}$ flowing through the first window 212 and the current $I_{126}$ flowing through the second window 214 must be equal. Thus, $$I_{126}(\text{through window } \mathbf{212})=I_{126}(\text{through window } \mathbf{214})$$

and $$2I_{108}+I_{142}+I_{134}=I_{108}+I_{112}+2I_{134}+I_{172}$$

and rearranging the previous equation yields, $$I_{108}+I_{142}=I_{112}+I_{134}+I_{172}.$$

Since the current $I_{142}$ and the current $I_{112}$ both feed the voltage $+(1.5*V_{LL})$, they are essentially equal in value. Additionally, since the current $I_{108}$ and the current $I_{134}$ both feed the voltage $-(1.5*V_{LL})$, they are also essentially equal in value. This leads to the conclusion that $I_{172}$ must be equal to zero, since all ampere-turn products through each window 212, 214 sum to zero.

Thus, all ampere-turn products sum to zero except for $I_{172}$. It should be noted that $I_{172}$ feeds the voltage $+(0.5*V_{LL})$. However, the current $I_{172}$ is a small current compared with the current $I_{126}$. In one embodiment, the value of the current $I_{172}$ is less than ten percent of the value of the current $I_{126}$.

Figure 4:
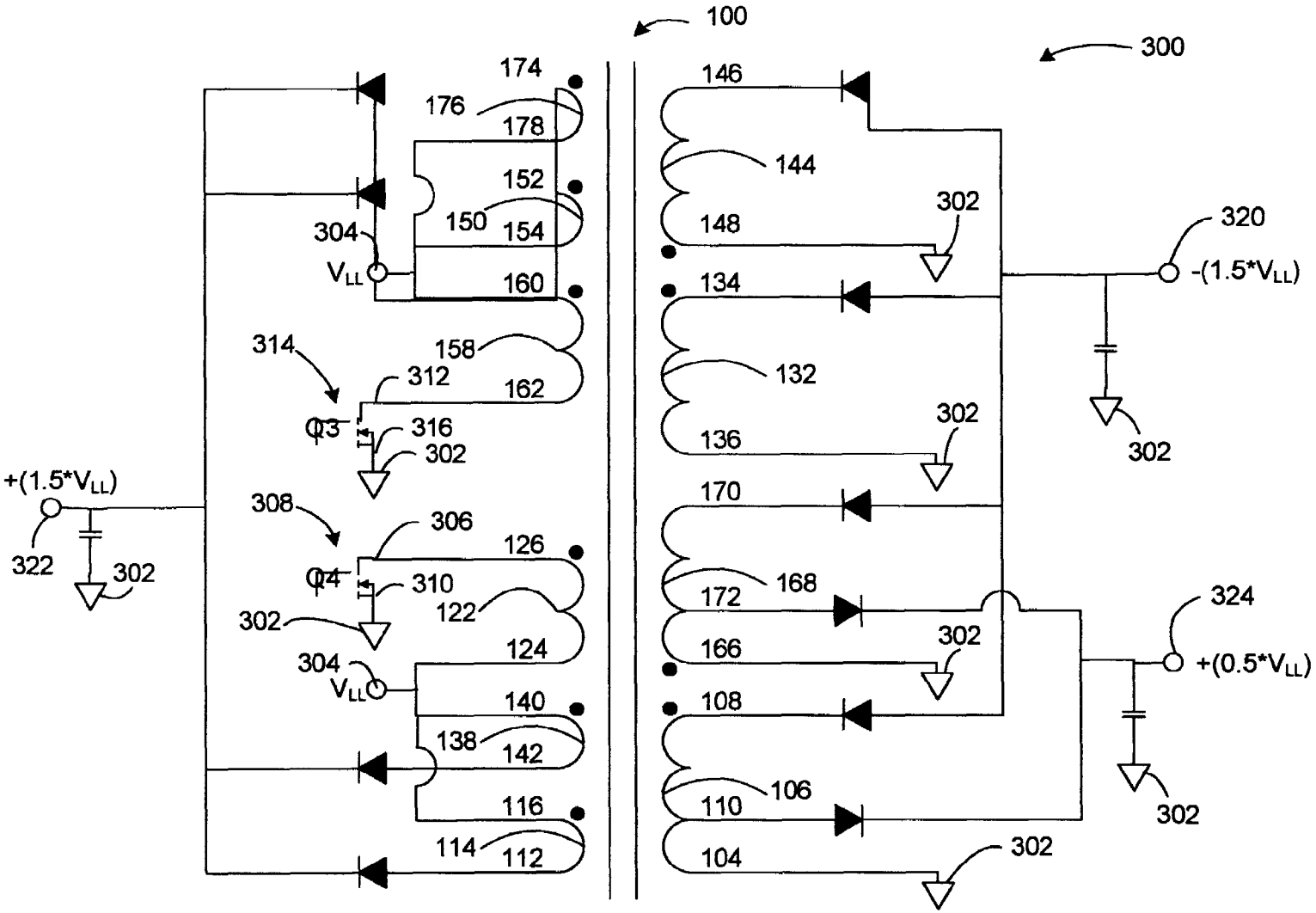
FIG. 4 is a schematic illustration of a power supply circuit including the transformer of FIG. 1.

FIG. 4 is a schematic illustration of a power supply circuit 300 including the transformer 100 of FIG. 1. The transformer 100 includes two step-up autotransformer windings, two step-up isolation transformer windings, and two other step-up isolated transformer windings with tapped windings for a step down output.

The first terminal 104, the eighth terminal 136, the twelfth terminal 148, and the seventeenth terminal 166 of the transformer 100 are coupled to ground 302. The fourth terminal 116, the fifth terminal 124, the ninth terminal 140, the fourteenth terminal 154, the fifteenth terminal 160, and the twentieth terminal 178 are all coupled to the voltage source $V_{LL}$ 304.

The sixth terminal 126 of the transformer 100 is coupled to the drain terminal 306 of a transistor Q4 (MOSFET) 308. The source terminal 310 of the transistor Q4 308 is coupled to ground 302.

The sixteenth terminal 162 of the transformer 100 is coupled to the drain 312 of a transistor Q3 314. The source terminal 316 of the transistor Q3 314 is coupled to ground 302.

In operation, during the first half of the cycle, the transistor Q4 308 is activated. A load connected to the output terminal 322 causes a current to flow through the second coil winding 122 as well as the first 114 and the second fractional windings 138. The first 114 and the second fractional windings 138 are connected in a parallel configuration. By parallel configuration, we mean that the two windings, including their output diodes, are connected to common points at their beginning and end. By properly designing this parallel connection, the currents through the two windings will be substantially equal. This first segment of the autotransformer includes one and one-half turns thereby forming a step-up transformer. Thus, the output 322 is equivalent to $+(1.5*V_{LL})$.

During the second half of the cycle, the transistor Q3 314 is activated and the transistor Q4 308 is deactivated. The load connected to the output terminal 322 causes a current to flow through the fifth coil winding 158 as well as the third 150 and the fourth fractional windings 176. The third 150 and the fourth fractional windings 176 are connected in a parallel configuration. This second segment of the autotransformer includes one and one-half turns and is symmetrical to the first segment. The output 322 is again equivalent to $+(1.5*V_{LL})$.

The transformer 100 also includes a first pair of isolation transformer windings 144, 132, and a second pair of isolation transformer windings 168, 106 that are symmetric to the first pair. Each winding 144, 132, 168, 106 includes one and one-half turns thereby forming step-up transformers. By properly configuring the phasing of the windings 144, 132, 168, 106 (as indicating in the FIG. 4), the output 320 can be designed to be equivalent to $-(1.5*V_{LL})$.

Additionally, the two step-up isolated transformer windings 106 and 168 include taps 110 and 172, respectively. The tapped windings 106, 168 each include one-half winding to create a step down transformer output 324 of $+(0.5*V_{LL})$.

Other power supply configurations (not shown) can also be used including configurations using planar transformers having discrete primary and secondary windings.

Additionally, the foregoing description is intended to be merely illustrative of the present invention and should not be construed as limiting the appended claims to any particular embodiment or group of embodiments. Thus, while the present invention has been described with reference to exemplary embodiments, it should also be appreciated that numerous modifications and alternative embodiments may be devised by those having ordinary skill in the art without departing from the broader and intended spirit and scope of the present invention as set forth in the claims that follow. In addition, the section headings included herein are intended to facilitate a review but are not intended to limit the scope of the present invention. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

What is claimed is:

1. A planar transformer comprising:

a multilayer printed circuit board comprising more than two layers;

a magnetic core coupled to the multilayer printed circuit board comprising a common leg and at least a first and a second return leg, the common leg and the first return leg forming a first core window and the common leg and the second return leg forming a second core window;

a first coil comprising a first coil winding formed on one or more layers of the multilayer printed circuit board, the first coil winding passing through each of the first and second core windows; and a second coil comprising a plurality of coil windings formed on one or more layers of the multilayer printed circuit board, at least two of the plurality of coil windings comprising fractional turn windings, each of the plurality of coil windings passing through at least one of the first and the second core windows and being interconnected such that the sum of ampere turn products from all of the coil windings passing through each of the first and the second core windows is substantially equal to zero.

2. The planar transformer of claim 1 wherein the magnetic core further comprises a third return leg that forms a third core window.

3. The planar transformer of claim 1 wherein at least two of the fractional windings comprise half turn windings.

4. The planar transformer of claim 1 wherein the magnetic core comprises the common leg and a plurality of return legs that correspond to a plurality of core windows.

5. The planar transformer of claim 4 wherein a magnetic flux generated in the common leg is substantially equally distributed in the plurality of return legs.

6. The planar transformer of claim 1 wherein the absolute value of the difference between an ampere turn product from the first coil winding passing through the first core window and the sum of ampere turn products of the plurality of coil windings passing through the first core window is less than ten percent of the ampere turn product from the first coil winding passing through the first core window.

7. The planar transformer of claim 1 wherein the absolute value of the difference between an ampere turn product from the first coil winding passing through the second core window and the sum of ampere turn products of the plurality of coil windings passing through the second core window is less than ten percent of the ampere turn product from the first coil winding passing through the second core window.

8. The planar transformer of claim 1 wherein at least one of the common leg, the first return leg, and the second return leg passes through the multilayer printed circuit board.

9. The planar transformer of claim 1 wherein the magnetic core comprises multiple parts, the multiple parts being coupled together from opposite sides of the printed circuit board.

10. The planar transformer of claim 1 wherein the first coil comprises a primary coil and the second coil comprises a secondary coil.

11. The planar transformer of claim 1 wherein the second coil comprises a primary winding and the first coil comprises a secondary coil.

12. The planar transformer of claim 1 wherein the magnetic core comprises a pre-fabricated magnetic material.

13. The planar transformer of claim 1 wherein the planar transformer comprises a component in an audio amplifier.

14. A power supply comprising:

a voltage input terminal;

a planar transformer electrically coupled to the voltage input terminal, the planar transformer comprising;

a multilayer printed circuit board comprising more than two layers;

a magnetic core coupled to the multilayer printed circuit board comprising a common leg and at least a first and a second return leg, the common leg and the first return leg forming a first core window and the common leg and the second return leg forming a second core window;

a first coil comprising a first coil winding formed on one or more layers of the multilayer printed circuit board, the first coil winding passing through each of the first and second core windows; and a second coil comprising a plurality of coil windings formed on one or more layers of the multilayer printed circuit board, at least two of the plurality of coil windings comprising fractional turn windings, each of the plurality of coil windings passing through at least one of the first and the second core windows and being interconnected such that the sum of ampere turn products from all of the coil windings in each of the first and the second core windows is substantially equal to zero; and an output terminal coupled to the planar transformer.

15. The power supply of claim 14 wherein the output terminal supplies voltage to an audio amplifier.

16. The power supply of claim 14 wherein the magnetic core comprises the common leg and a plurality of return legs that correspond to a plurality of core windows.

17. The power supply of claim 16 wherein a magnetic flux generated in the common leg is substantially equally distributed in the plurality of return legs.

18. The power supply of claim 14 wherein the absolute value of the difference between an ampere turn product from the first coil winding passing through the first core window and the sum of ampere turn products of the plurality of coil windings passing through the first core window is less than ten percent of the ampere turn product from the first coil winding passing through the first core window.

19. The power supply of claim 14 wherein the absolute value of the difference between an ampere turn product from the first coil winding passing through the second core window and the sum of ampere turn products of the plurality of coil windings passing through the second core window is less than ten percent of the ampere turn product from the first coil winding passing through the second core window.

20. The power supply of claim 14 wherein at least two of the fractional windings comprise half turn windings.

21. The power supply of claim 14 wherein the magnetic core comprises a pre-fabricated magnetic material.

22. The power supply of claim 14 wherein at least one of the common leg, the first return leg, and the second return leg passes through the multilayer printed circuit board.

23. The power supply of claim 14 wherein the magnetic core comprises multiple parts, the multiple parts being coupled together from opposite sides of the printed circuit board.

24. A method for transforming an electrical current, the method comprising the acts of:

forming a magnetic core comprising a first core window and a second core window;

coupling the magnetic core to a multilayer printed circuit board comprising more than two layers;

forming a first coil comprising a first coil winding on one or more layers of a multilayer printed circuit board; the first coil winding passing through each of the first and second core windows; and forming a second coil comprising a plurality of coil windings on one or more layers of the multilayer printed circuit board, at least two of the plurality of coil windings comprising fractional turn windings, each of the plurality of coil windings passing through at least one of the first and the second core windows and being interconnected such that the sum of ampere turn products from all of the coil windings in each of the first and the second core windows is substantially equal to zero.

25. The method of claim 24 wherein at least two of the fractional windings comprise half turn windings.

26. The method of claim 24 wherein the magnetic core comprises a common leg and a plurality of return legs that correspond to a plurality of core windows.

27. The method of claim 24 further comprising generating a magnetic flux in the common leg and equally distributing the magnetic flux in the plurality of return legs.

28. The method of claim 24 further comprising passing at least one of the common leg, the first return leg, and the second return leg through the multilayer printed circuit board.

29. A planar transformer comprising:

a multilayer printed circuit board comprising more than two layers;

a first coil comprising at least one full turn winding formed on one or more layers of the multilayer printed circuit board;

a second coil comprising a plurality of windings formed on one or more layers of the multilayer printed circuit board, at least two of the plurality of windings comprising fractional turn windings that are connected in a parallel configuration; and a magnetic core that inductively couples the plurality of windings to the at least one full turn winding, the magnetic core comprising at least two core windows corresponding to the at least two fractional turn windings.

30. The planar transformer of claim 29 wherein each of the at least two fractional windings passes through one of the at least two core windows.

31. The planar transformer of claim 29 wherein the magnetic core comprises a common leg and a plurality of legs that correspond to a plurality of core windows.

32. The planar transformer of claim 29 wherein at least two of the fractional windings comprise half turn windings.

33. The planar transformer of claim 29 wherein the absolute value of the difference between an ampere turn product from the full turn winding passing through one of the two core windows and the sum of ampere turn products of the plurality of coil windings passing through the one of the two core windows is less than ten percent of the ampere turn product from the full turn winding passing through the one of the two core windows.

34. The planar transformer of claim 29 wherein the magnetic core comprises a pre-fabricated magnetic material.

35. The planar transformer of claim 29 wherein the transformer is a component of an audio amplifier.

36. A method for transforming an electrical current, the method comprising the acts of:

forming a first coil comprising at least one full turn winding on one or more layers of a multilayer printed circuit board comprising more than two layers;

forming a second coil comprising a plurality of windings on one or more layers of the multilayer printed circuit board, at least two of the plurality of windings comprising fractional turn windings that are connected in a parallel configuration; and inductively coupling the plurality of windings to the at least one full turn winding through a magnetic core comprising at least two core windows corresponding to the at least two fractional turn windings.

37. The method of claim 36 wherein at least two of the fractional windings comprise half turn windings.

38. The method of claim 36 wherein the absolute value of the difference between an ampere turn product from the full turn winding passing through one of the two core windows and the sum of ampere turn products of the plurality of coil windings passing through the one of the two core windows is less than ten percent of the ampere turn product from the full turn winding passing through the one of the two core windows.

39. A planar transformer comprising:

means for forming a magnetic core comprising a first core window and a second core window;

means for coupling the magnetic core to a multilayer printed circuit board comprising more than two layers;

means for forming a first coil comprising a first coil winding on one or more layers of a multilayer printed circuit board; the first coil winding passing through each of the first and second core windows; and means for forming a second coil comprising a plurality of coil windings on one or more layers of the multilayer printed circuit board, at least two of the plurality of coil windings comprising fractional turn windings, each of the plurality of coil windings passing through at least one of the first and the second core windows and being interconnected such that the sum of ampere turn products from all of the coil windings in each of the first and the second core windows is substantially equal to zero.

40. A planar transformer comprising:

means for forming a first coil comprising at least one full turn winding on one or more layers of a multilayer printed circuit board comprising more than two layers;

means for forming a second coil comprising a plurality of windings on one or more layers of the multilayer printed circuit board, at least two of the plurality of windings comprising fractional turn windings that are connected in a parallel configuration; and means for inductively coupling the plurality of windings to the at least one full turn winding through a magnetic core comprising at least two core windows corresponding to the at least two fractional turn windings.

* * * * *